US007914113B2

(12) United States Patent
Kim

(10) Patent No.: US 7,914,113 B2
(45) Date of Patent: Mar. 29, 2011

(54) PRINT HEAD HAVING NOZZLES WITH VARIED SPACING AND INKJET PRINTER INCLUDING THE SAME

(75) Inventor: Jung-hwan Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 719 days.

(21) Appl. No.: 11/862,557

(22) Filed: Sep. 27, 2007

(65) Prior Publication Data

US 2008/0192086 A1 Aug. 14, 2008

(30) Foreign Application Priority Data

Feb. 13, 2007 (KR) ..... 10-2007-0015062

(51) Int. Cl.
*B41J 2/15* (2006.01)
*B41J 2/145* (2006.01)

(52) U.S. Cl. ..... 347/40; 347/43

(58) Field of Classification Search ..... 347/12, 347/13, 40, 42–44, 47, 102, 20
See application file for complete search history.

(56) References Cited

U.S. PATENT DOCUMENTS 5,734,394 A * 3/1998 Hackleman ..... 347/42

FOREIGN PATENT DOCUMENTS

| | | |
|---|---|---|
| JP | 6-171084 | 6/1994 |
| JP | 2000-141645 | 5/2000 |
| JP | 2005-161711 | 6/2005 |
| KR | 1999-27335 | 7/1999 |

* cited by examiner

*Primary Examiner* — Juanita D Stephens
(74) *Attorney, Agent, or Firm* — Stanzione & Kim, LLP

(57) ABSTRACT

A print head includes a first nozzle group which includes a plurality of first nozzles arranged linearly, and a second nozzle group and a third nozzle group which include a plurality of second nozzles and a plurality of third nozzles arranged linearly, and are disposed in parallel with each other and spaced from the first nozzle group by a first interval and a second interval at opposite sides of the first nozzle group, respectively.

24 Claims, 10 Drawing Sheets

PRINT HEAD HAVING NOZZLES WITH VARIED SPACING AND INKJET PRINTER INCLUDING THE SAME

CROSS-REFERENCE TO RELATED APPLICATIONS

This application claims priority from Korean Patent Application No. 10-2007-0015062, filed on Feb. 13, 2007 in the Korean Intellectual Property Office, the disclosure of which is incorporated herein in its entirety by reference.

BACKGROUND OF THE INVENTION

1. Field of the Invention

The present general inventive concept relates to a print head and an inkjet printer including the same, and more particularly, to a print head improved in an ink drying quality and an inkjet printer including the same.

2. Description of the Related Art

In general, an ink jet printer jets a fine droplet of a printing ink onto a predetermined position to form an ink image on a printing medium.

As illustrated in FIG. 1, a conventional ink jet printer has a head unit 20 jetting an ink onto a printing medium S, and a controller (not shown) controlling an ink jet speed of the head unit 20.

The head unit 20 includes a base plate 21 and a plurality of print heads 23 supported by the base plate 21 and manufactured as a unit chip by a semiconductor process. The print heads 23 are disposed in a zigzag manner in the base plate 21 along a transverse direction Z to a feeding direction X of the printing medium S.

As illustrated in FIG. 2, each print head 23 has first through fourth nozzles N1 through N4 jetting a black K, cyan C, magenta M, and yellow Y inks, respectively. The plurality of first nozzles N1 through fourth nozzles N4 are linearly arranged in the transverse direction Z and form first through fourth nozzle groups L1 through L4, respectively.

FIG. 3 is an enlarged schematic view illustrating a pixel formed by an ink dot when a predetermined color image is formed on the printing medium S at a resolution of 1200 dpi. In FIG. 3, the ink dots Y, M, C and K are illustrated as if they are shifted by a short distance in the transverse direction Z to help understanding. However, the ink dots Y, M, C, and K are supposed to be formed in a pixel center point F.

As shown in FIG. 3, the yellow, magenta, cyan, and black inks are jetted during feeding the printing medium S in the feeding direction X, thereby forming ink dots Y, M, C, and K. Also, the controller (not shown) considers a transmitting speed of the printing medium S and controls the ink jet speed of the print head 23 so that the ink dots Y, M, C, and K can be formed on the same pixel centerline X1 in the feeding direction X.

However, the ink is jetted so that the ink dots Y, M, C, and K can be formed on the same pixel centerline X1 in the feeding direction X. Thus, the ink of different color is jetted before the previously jetted ink is dried, so that an ink drying performance is deteriorated and the color expression becomes unstable.

Also, an ink dot region for four colors has the same size with that for one color. Therefore, the ink dot region occupies a small area of a unit pixel on the printing medium S.

Meanwhile, to solve these problems, the controller needs to be redesigned to control an ink jet timing of each nozzle N1, N2, N3, and N4 of the print head 123 so that the ink dot regions can have centers E1, E2, E3, and E4.

SUMMARY OF THE INVENTION

The present general inventive concept provides a print head and an ink jet printer including the same, which are improved in an ink drying quality by structural change.

Additional aspects and utilities of the present general inventive concept will be set forth in part in the description which follows and, in part, will be obvious from the description, or may be learned by practice of the general inventive concept.

The foregoing and/or other aspects of the present general inventive concept can be achieved by providing a print head comprising a first nozzle group which comprises a plurality of first nozzles arranged linearly, and a second nozzle group and a third nozzle group which comprise a plurality of second nozzles and a plurality of third nozzles arranged linearly, and are disposed in parallel with each other and spaced from the first nozzle group by a first interval and a second interval at opposite sides of the first nozzle group, respectively.

The print head may further include a fourth nozzle group arranged in parallel with and spaced apart from one of the second and third nozzle groups by a third interval equal to one of the first and second intervals.

The print head may further includes a fourth nozzle group arranged in parallel with and spaced apart from one of the second nozzle group and the third nozzle group by a third interval different from at least one of the first and second intervals.

The foregoing and/or other aspects of the present invention can also be achieved by providing an ink jet printer comprising a print head, an ink tank, and a base plate which provides an ink of the ink tank to the print head, and supports the print head so that a lengthwise direction of each nozzle group can be crossed to a feeding direction of a printing medium.

The print head may be provided in plurality and disposed in the base plate along a transverse direction to the feeding direction.

The ink jet printer may further include a feeding unit which feeds the printing medium to the print head, and a controller which controls the print head and the feeding unit so that at least one of the ink dots generated on the printing medium by each nozzle group cannot be aligned with the other ink dots in the feeding direction.

The foregoing and/or other aspects of the present invention can also be achieved by providing a print head usable with an image forming apparatus, the print head including a first nozzle group having a plurality of first nozzles disposed on a first line, a second nozzle group having a plurality of second nozzles disposed on a second line parallel to the first line and spaced apart from the first line by a first distance, and a third nozzle group having a plurality of third nozzles disposed on a third line parallel to one of the first line and the second line and spaced apart from one of the first line and the second line by a second distance.

The foregoing and/or other aspects of the present invention can also be achieved by providing a print head usable with an image forming apparatus, the print head including a first nozzle group having a plurality of first nozzles disposed on a first line to eject ink of a first color, a second nozzle group having a plurality of second nozzles disposed on a second line parallel to the first line and spaced apart from the first line by a first distance to eject ink of a second color, a third nozzle group having a plurality of third nozzles disposed on a third line parallel to the second line and spaced apart from the second line by a second distance to eject ink of a third color, and a fourth nozzle group having a plurality of fourth nozzles disposed on a fourth line parallel to the third line and spaced apart from the third by a second distance to eject ink of a fourth color.

The foregoing and/or other aspects of the present invention can also be achieved by providing a print head usable with an image forming apparatus, the print head including a base plate, and a plurality of print heads disposed on the base plate and spaced apart from each other, each print head having a first nozzle group having a plurality of first nozzles disposed on a first line, a second nozzle group having a plurality of second nozzles disposed on a second line parallel to the first line and spaced apart from the first line by a first distance, and a third nozzle group having a plurality of third nozzles disposed on a third line parallel to one of the first line and the second line and spaced apart from one of the first line and the second line by a second distance.

The foregoing and/or other aspects of the present invention can also be achieved by providing an image forming apparatus including a print head comprising a first nozzle group having a plurality of first nozzles disposed on a first line, a second nozzle group having a plurality of second nozzles disposed on a second line parallel to the first line and spaced apart from the first line by a first distance, and a third nozzle group having a plurality of third nozzles disposed on a third line parallel to one of the first line and the second line and spaced apart from one of the first line and the second line by a second distance, and a controller to make a relative movement of a printing medium and the print head to form first, second, and third ink dots in a corresponding pixel of the printing medium at different regions of a pixel of the printing medium.

At least one of the different regions of the pixel may be disposed on an upper side or a lower side of a center line of the pixel.

The foregoing and/or other aspects of the present invention can also be achieved by providing an image forming apparatus including a print head comprising a first nozzle group having a plurality of first nozzles disposed on a first line to eject ink of a first color, a second nozzle group having a plurality of second nozzles disposed on a second line parallel to the first line and spaced apart from the first line by a first distance to eject ink of a second color, a third nozzle group having a plurality of third nozzles disposed on a third line parallel to the second line and spaced apart from the second line by a second distance to eject ink of a third color, and a fourth nozzle group having a plurality of fourth nozzles disposed on a fourth line parallel to the third line and spaced apart from the third by a second distance to eject ink of a fourth color, and a controller to make a relative movement of a printing medium and the print head to form first, second, third, and fourth ink dots in a corresponding pixel of the printing medium at first, second, third, and fourth regions of a pixel of the printing medium using the first, second, third, and fourth nozzles of the first, second, third, and fourth nozzle groups, respectively.

The first, second, third, and fourth ink dots may be disposed in the different regions disposed in a direction within the pixel.

At least one of the first, second, third, and fourth ink dots may not overlap another one of the first, second, third, and fourth ink dots.

At least one of the first, second, third, and fourth ink dots may not overlap at least the other one of the first, second, third, and fourth ink dots.

At least two of the first, second, third, and fourth ink dots may overlap each other.

At least two of the first, second, third, and fourth ink dots may be disposed in a feeding direction of the printing medium.

The first, second, third, and fourth ink dots may be disposed to overlap the adjacent ones of the first, second, third, and fourth ink dots.

BRIEF DESCRIPTION OF THE DRAWINGS

These and/or other aspects and utilities of the present general inventive concept will become apparent and more readily appreciated from the following description of the embodiments, taken in conjunction with the accompanying drawings, in which.

DETAILED DESCRIPTION OF THE PREFERRED EMBODIMENTS

Figure 1:
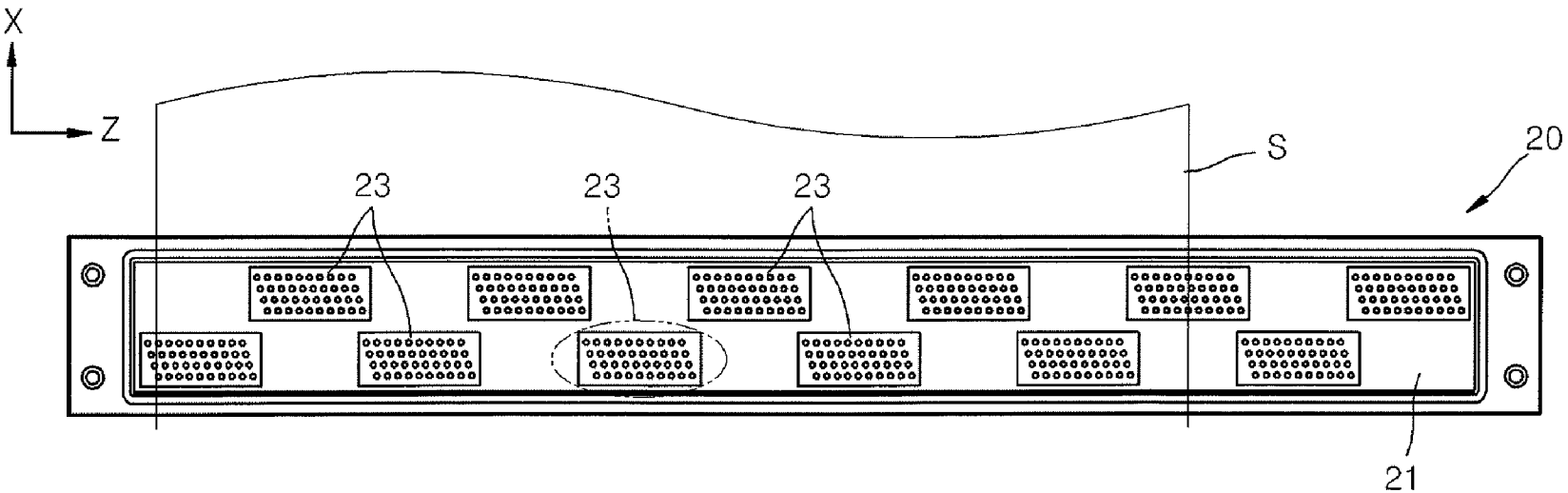
FIG. 1 (RELATED ART)
FIG. 1 is a partial plan view illustrating a conventional inkjet printer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
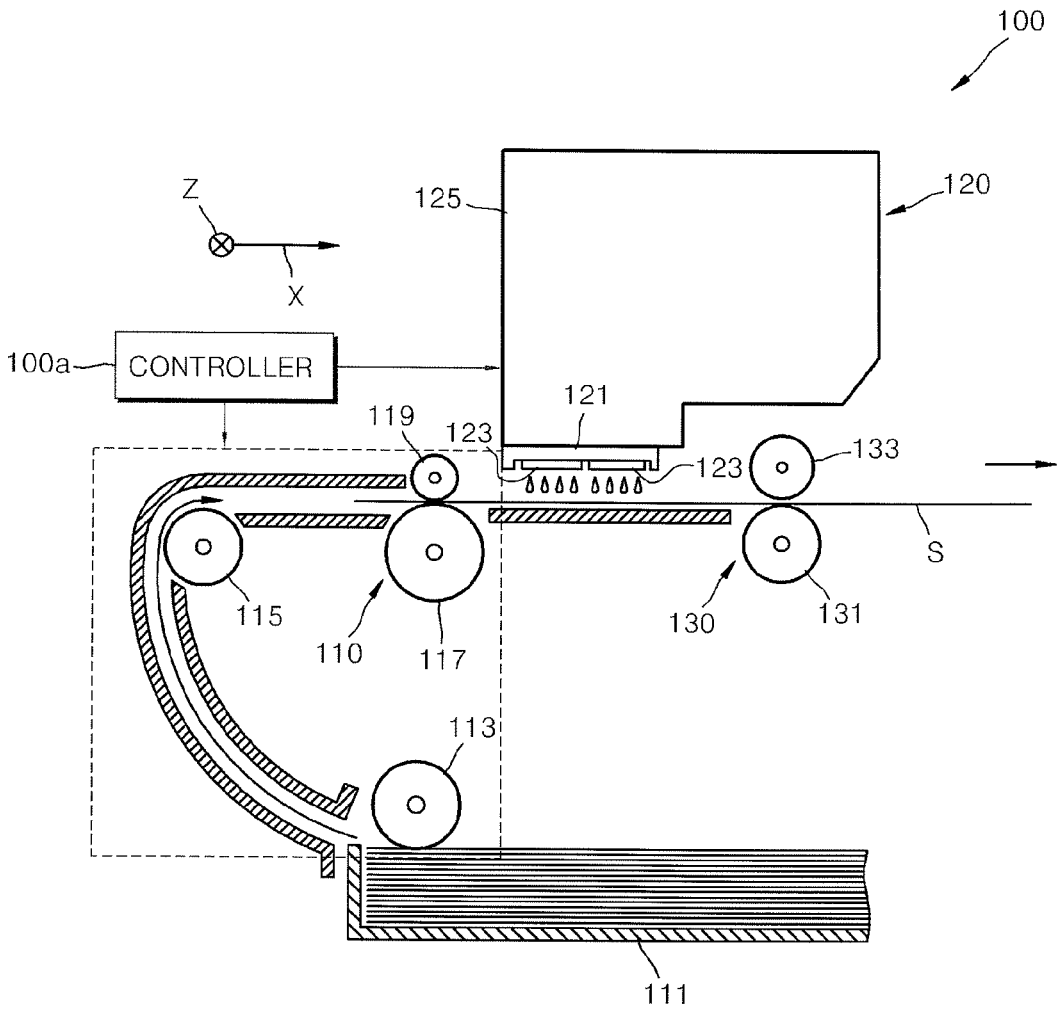
FIG. 4 is a schematic sectional view illustrating an inkjet printer according to an embodiment of the present general inventive concept.

As illustrated in FIG. 4, an image forming apparatus, such as an inkjet printer 100, according to an embodiment of the present general inventive concept includes a feeding unit 110, a head unit 120, a discharging unit 130, and a controller 100*a*.

The feeding unit 110 may include a feeding cassette 111, a pickup roller 113, an intermediate roller 115, a feed roller 117, and an idle roller 119. Printing media S filed in the feeding cassette 111 are separated as a sheet by the pickup roller 113, and advanced between the feed roller 117 and the idle roller 119 through the intermediate roller 115. Also, the feed roller 117 is driven by the controller 100*a* at an appropriate timing, and feeds the printing medium S to the head unit 120. The controller 100*a* can control at least one of the print unit 120 and the feeding unit 110 to make a relative movement of the printing medium S. Here, a print head of the printing unit 120 may be stationary with respect to a feeding path, and the controller 110*a* controls the feeding unit 110 to feed the printing medium S with respect to the print unit 120.

The discharging unit 130 has a discharging roller 131 and an idle roller 133, and discharges the printing medium S printed by the head unit 120.

Figure 5:
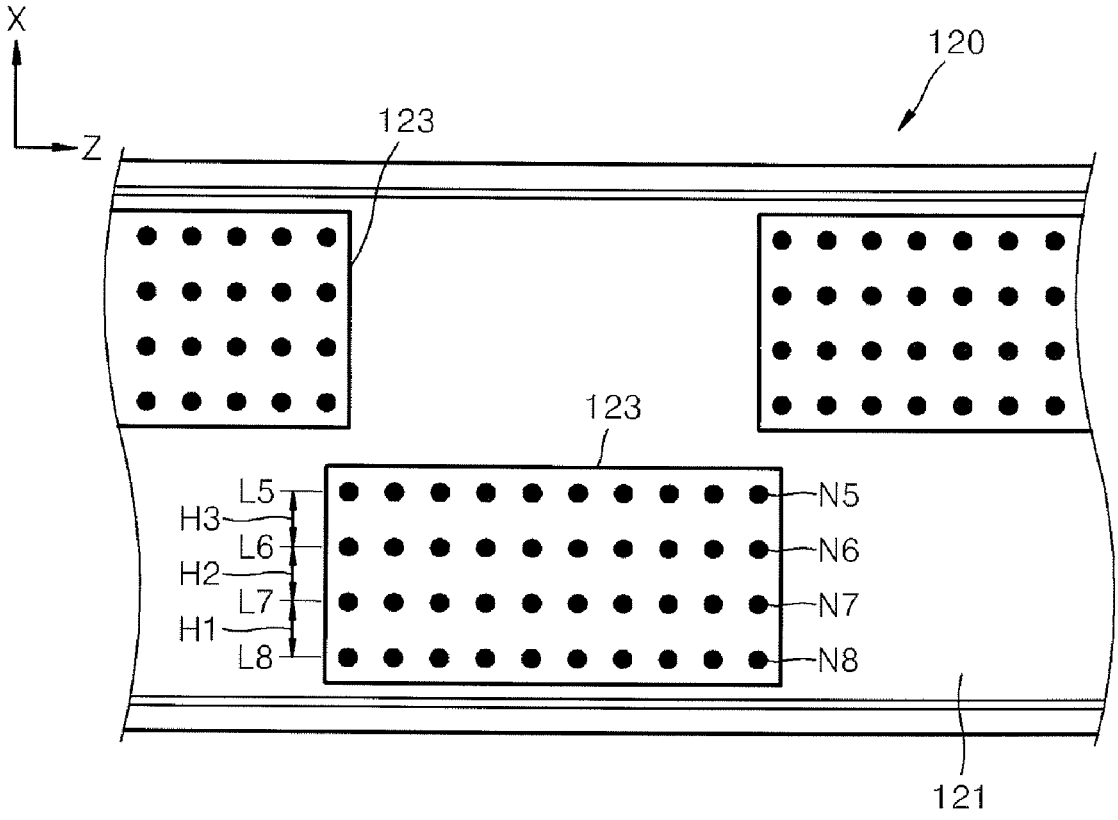
FIG. 5 is an enlarged plan view illustrating a print head in the inkjet printer of FIG. 4.

As illustrated in FIGS. 4 and 5, the head unit 120 has a base plate 121, a plurality of print heads 123, and an ink tank 125 to provide an ink to the base plate 121. Here, the plurality of print heads 123 are formed in and supported by the base plate 121.

The ink tank 125 stores the ink having a color corresponding to an ink color to be jetted from the print head 123. The ink tank 124 may have sub-ink tanks to stores ink of different colors to correspond to different nozzles of the print heads 123.

The base plate 121 includes ink channels (not illustrated) therein disposed between the ink tank 125 and the print heads 123 to provide the ink having the different colors to a plurality of nozzle groups L5, L6, L7, and L8 of the print head 123, respectively.

The ink channel allows ink outlets (not illustrated) of the ink tanks 125 (described later) different in color to communicate with a plurality of nozzles N5, N6, N7, and N8 of the nozzle groups L5, L6, L7, and L8, respectively.

Referring to FIG. 5, the print head 123 includes a yellow nozzle group L8, a magenta nozzle group L7, a cyan nozzle group L6, and a black nozzle group L5 along a feeding direction X of the printing medium S in FIG. 1 in order.

The nozzle groups L8, L7, L6 and L5 have the nozzles N8, N7, N6 and N5 to jet or eject the ink having the yellow, magenta, cyan, and black colors, respectively. The nozzles N8, N7, N6, and N5 may be linearly arranged.

Also, the nozzle groups L8, L7, L6, and L5 are disposed in parallel with each other. That is, the yellow nozzle group L8 and the magenta nozzle group L7 are arranged in parallel while being spaced by a first interval H1, the magenta nozzle group L7 and the cyan nozzle group L6 are arranged in parallel while being spaced by a second interval H2, and the cyan nozzle group L6 and the black nozzle group L5 are arranged in parallel while being spaced by a third interval H3. Also, at least one of the first through third intervals H1 through H3 is different from another one.

In the meantime, the print head 123 may include a plurality of ink chambers (not illustrating) having a driving unit (for example, a piezoelectric element for a piezoelectric type, or a heater for a thermal driving type) to control a corresponding one of the ink chambers and independently communicating with each of the nozzles N8, N7, N6 and N5, to provide a pressure to jet the ink, a manifold used as a common channel to provide the ink accommodated in the ink tank 125 to the ink chamber, and a restrictor used as an individual channel to provide the ink from the manifold to the ink chamber. The detailed description for the ink chamber, the manifold, and the restrictor, etc. is omitted because it has been known by those skilled in the art.

The print head 123 having above described configuration is manufactured by semiconductor processes such as deposition, lithography, and plating. The detailed description of the manufacture process is omitted because it has been known by those skilled in the art.

Figure 6:
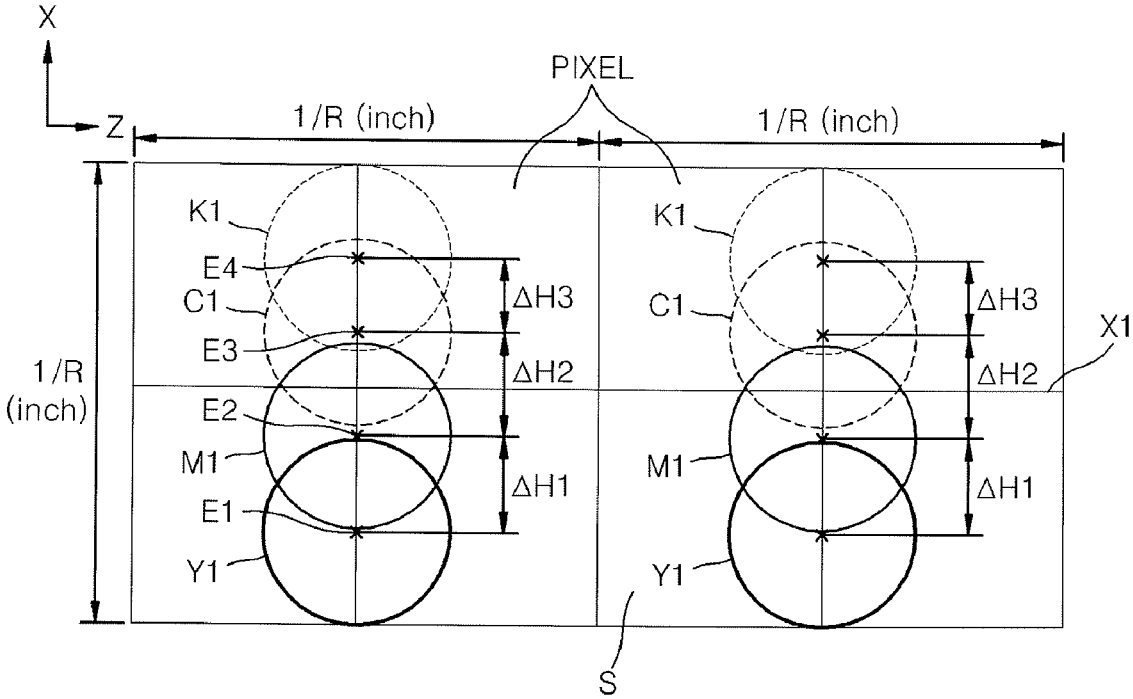
FIG. 6 is an enlarged view of a pixel being formed on a printing medium by the print head of FIG. 5.

FIG. 6 illustrates a pixel formed by ink dots Y1, M1, C1, and K1 jetted by the yellow, magenta, cyan, and black nozzles N8, N7, N6, and N5 as a predetermined resolution R (the unit is dpi). The pixel has a printing region having a length of 1/R inch and a width of 1/R inch. The ink dots Y1, M1, C1, and K1 may be formed within a region defining the pixel of the printing medium S with respect to a reference center line X1 using the yellow, magenta, cyan, and black nozzles N8, N7, N6, and N5 of the print head 123 disposed in the feeding direction X.

The pixel illustrated in FIG. 6 is formed according to the following process. The controller 100*a* drives the feed roller 117 to feed the printing medium S in FIG. 4 in the feeding direction X. Accordingly, if the printing medium S in FIG. 4 is fed to a position to form the image, the yellow nozzle group L8 is controlled to form the yellow ink dot Y1. Also, the magenta, cyan, and black nozzle groups L7, L6, and L5 are sequentially controlled to form the magenta, cyan, and black ink dots M1, C1, and K1. The driving unit can be provided to correspond to each ink chamber and each nozzle of the head unit 120.

Here, the same controller of a conventional ink jet printer can be used as the controller 110*a*. That is, each nozzle group L5, L6, L7, and L8 is controlled at the same ink jet timing with the conventional timing. By this, ink drying quality is enhanced and a dot coverage increases by changing the structure of the print head 123.

Figure 2:
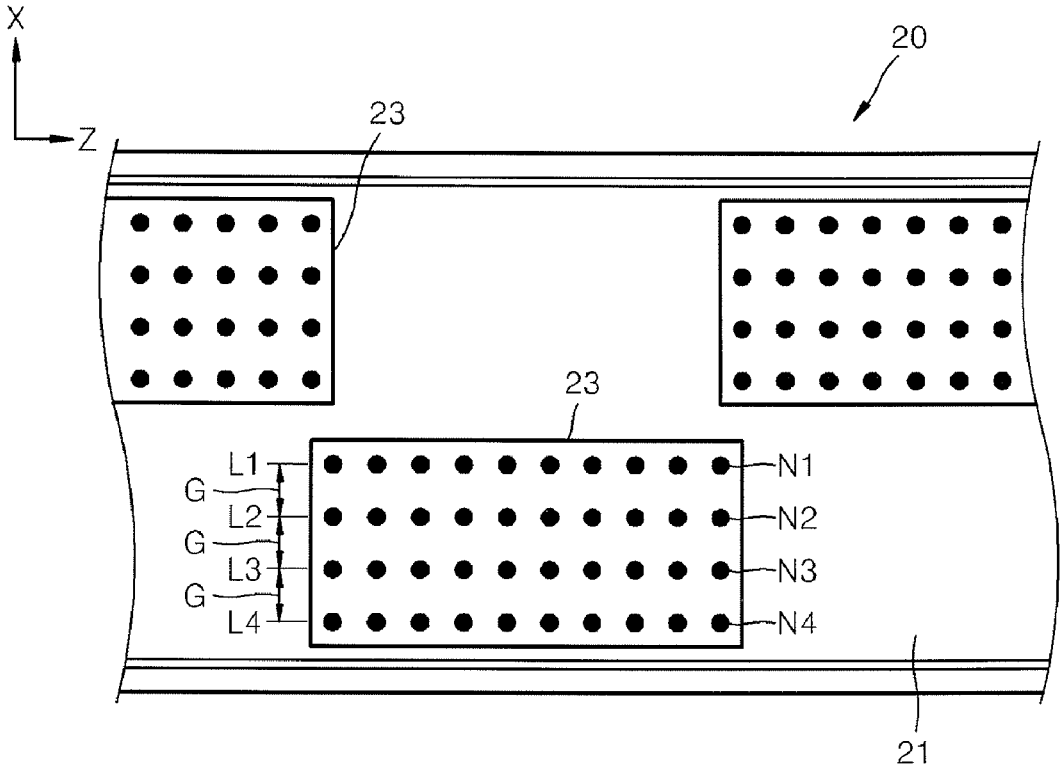
FIG. 2 (RELATED ART)
FIG. 2 is an enlarged plan view illustrating a print head in FIG. 1.
Figure 3:
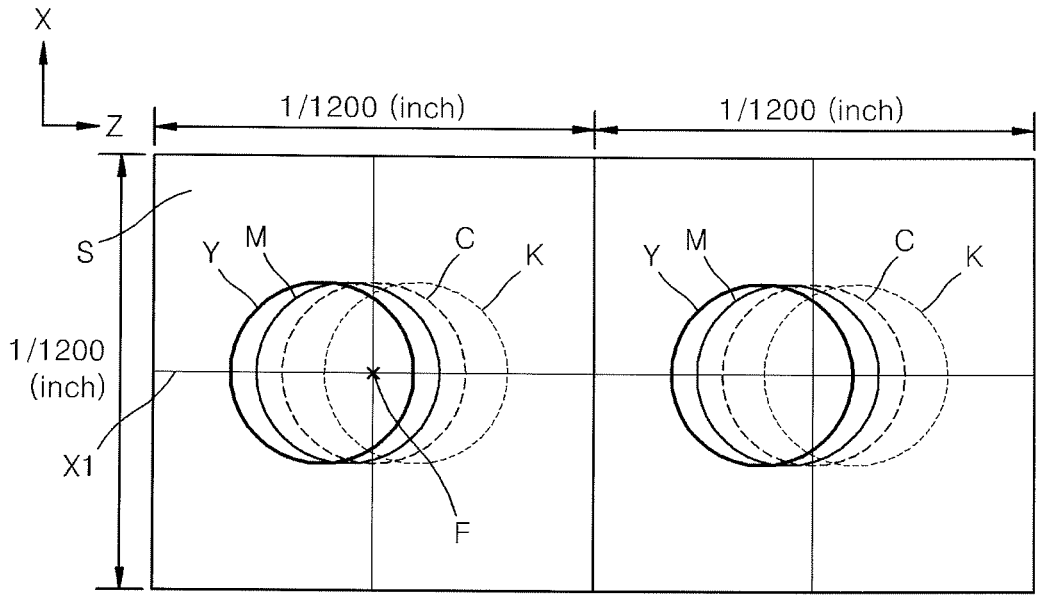
FIG. 3 (RELATED ART)
FIG. 3 is an enlarged view illustrating an ink dot formed on a printing medium by the print head in FIG. 2.

That is, a conventional print head 23 has a constant interval G between the nozzle groups illustrated in FIGS. 2 and 3. However, the print head 123 according to an exemplary embodiment of the present general inventive concept is used so that jetting center points E1, E2, E3, and E4 of the ink dots Y1, M1, C1, and K1 can be formed on different regions of the pixel of the printing medium S along the feeding direction X.

For example, the printing medium S can be fed at a constant speed with respect to the head unit 120, and the controller 100*a* controls the drivers of the head unit 120 to eject ink droplets from corresponding nozzles to form ink dots on, before, and/or after a centerline X1 of the pixel of the printing medium S in different regions of the pixel of the printing medium S. When intervals between the nozzles in the feeding direction X or the nozzle groups in the feeding direction X are same, the ink dots can be formed on the same regions on the center line X1 of the pixel of the printing medium S fed at the constant speed with respect to the head unit 120. Since at least one of intervals between the nozzles in the feeding direction X or the nozzle groups in the feeding direction X is not the same as the other intervals, the ink dots can be formed on different regions on the corresponding ones of the jetting center points E1, E2, E3, and E4 within the pixel of the printing medium S fed at the constant speed with respect to the head unit 120.

It is possible that the controller 100*a* can control at least one of the head unit 120 and the feeding unit 110 to make a relative movement between the print head 123 and the printing medium S so that the ink dots can be formed in different regions of the pixel.

Hereinbelow, methods to determine the first, second, and third intervals H1, H2, and H3 of the print head 123 will be described in detail so that the pixel may be formed according to patterns of FIGS. 6 through 10.

Referring to FIGS. 7 to 10, the ink dots are shifted by a short distance in the transverse direction Z for illustration purposes.

As illustrated in FIG. 6, the magenta ink dot M1 is shifted with respect to the yellow ink dot Y1 to the feeding direction X by a first interval deviation $\Delta H1=G-H1$ which is obtained by subtracting the first interval H1 from an interval G between conventional nozzle groups of FIG. 2. At that time, if the first interval deviation $\Delta H1$ has a plus (or positive) value, i.e., if the first interval H1 is narrower than the conventional interval G, the magenta ink dot M1 is formed so that the jetting center point E2 of the magenta ink dot M1 can be placed in back of the jetting center point E1 of the yellow ink dot Y1 with respect to the feeding direction X on the contrary to FIG. 6.

That is, the jetting center point E2 of the magenta ink dot M1 can be placed at a lower side with respect to the jetting center point E1 of the yellow ink dot Y1.

On the other hand, if the first interval deviation ΔH1 has a minus (or negative) value, i.e., if the first interval H1 is wider than the conventional interval G, as illustrated in FIG. 6, the magenta ink dot M1 is formed so that the jetting center point E2 of the magenta ink dot M1 can be placed in front of the jetting center point E1 of the yellow ink dot Y1 with respect to the feeding direction X.

That is, the jetting center point E2 of the magenta ink dot M1 can be placed at an upper side with respect to the jetting center point E1 of the yellow ink dot Y1 as illustrated in FIG. 6.

Meanwhile, the cyan ink dot C1 is shifted with respect to the magenta ink dot M1 in the feeding direction X by a second interval deviation ΔH2=G−H2 which is obtained by subtracting the second interval H2 from the interval G between the conventional nozzle groups. The jetting center point E3 of the cyan ink dot C1 is shifted in a counter direction of the feeding direction X or in the feeding direction X with respect to the jetting center point E2 of the magenta ink dot M1 respectively according to the plus and minus signs (values) of the second interval deviation ΔH2 like as the position of the jetting center point E2 of the magenta ink dot M1 is changed according to the sign changes of the first interval deviation ΔH1.

The black ink dot K1 is shifted with respect to the cyan ink dot C1 to the feeding direction X by a third interval deviation ΔH3=G−H3 which is obtained by subtracting the third interval H3 from the interval G between the conventional nozzle groups. Here, the relative position of the jetting center point E4 of the black ink dot K1 varies with regard to the jetting center point E3 in the cyan ink dot C1 according to the value of the third interval deviation ΔH3=G−H3.

In the meantime, if diameters of the nozzles N1, N2, N3, and N4 are equal to one another under the same condition, the diameter may be approximately D.

Here, it is possible that the value which is obtained by adding the sum of an absolute value of the first through third interval deviations ΔH1 through ΔH3 and the diameter D of the ink dot can be equal to or smaller than the length of the pixel 1/R if the first through third interval deviations ΔH1 through Δ3 have the same sign, i.e., if each of the jetting center point E1, E2, E3, and E4 of each ink dot Y, M, C, or K along the feeding direction X is aligned as illustrated in FIG. 6.

For example, if the resolution R is 1200 dpi and the interval G of the conventional print head 23 in FIG. 2 is, for example, 67/1200 inch, the jetting point of the ink dot of FIG. 6 is formed without the change of the controller.

$$\frac{1}{R} = \frac{1}{1200} \geq |G - H1| + |G - H2| + |G - H3| \quad \text{[Formula 1]}$$

Here, if H1>G, H2>G, and H3>G, [formula 2] is given as follows.

$$\frac{1}{1200} \geq H1 + H2 + H3 - 3G \quad \text{[Formula 2]}$$

The values of H1, H2, and H3 which satisfy [formula 2] and of which at least one interval is different from another one may be selected as follows.

$$H1 = \frac{135}{4800}\,(\text{inch}) = 714\ (\mu\text{m})$$

$$H2 = \frac{133}{4800}\,(\text{inch}) = 704\ (\mu\text{m})$$

$$H3 = \frac{135}{4800}\,(\text{inch}) = 714\ (\mu\text{m})$$

The first through third intervals H1 through H3 may be selected as other values satisfying [formula 2].

Figure 7:
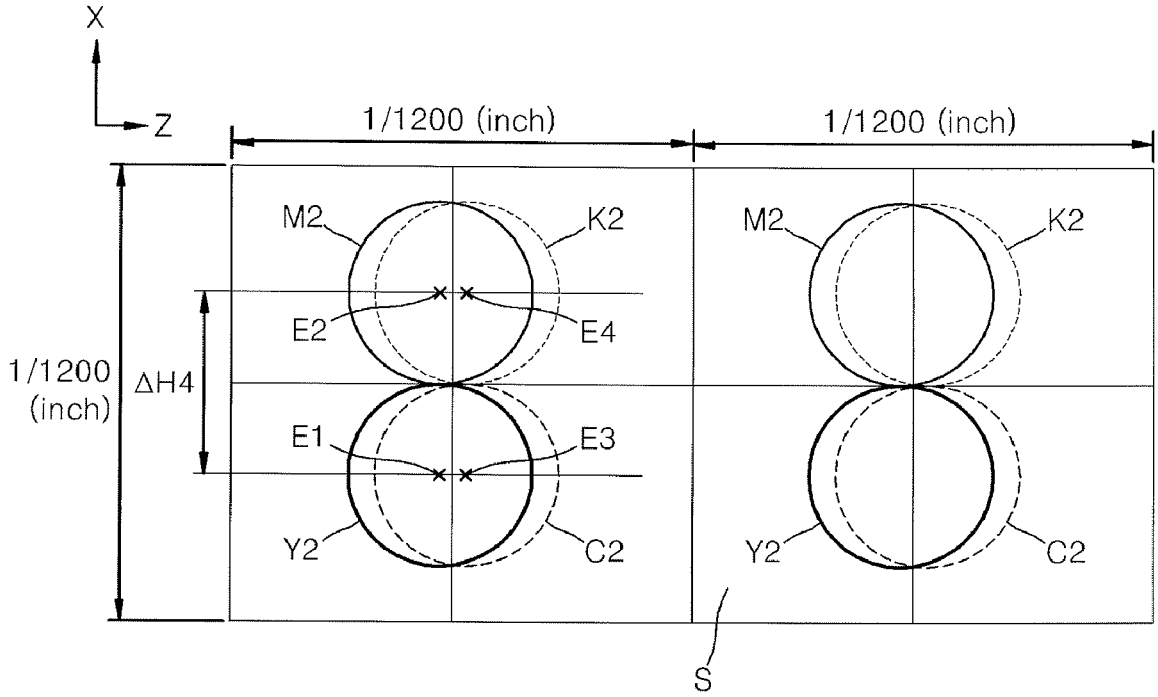
FIG. 7 is a view illustrating a pixel being formed on a printing medium by the print head of FIG. 5.

Meanwhile, in FIG. 7, one color pixel is formed as a pattern where the magenta ink dot M2 and the black ink dot K2 are overlapped with each other and the yellow ink dot Y2 and the cyan ink dot C2 are overlapped each other. The jetting center point E2 is disposed on the same line of the jetting center point E4, and the jetting center point E1 is disposed on the same line of the jetting center point E3.

The first through third intervals H1 via H3 of the print head 123 may be determined to form the ink dots Y2, M2, C2, and K2 as the same pattern as illustrated in FIG. 7.

For convenience, the resolution is 1200 dpi in FIGS. 7 through 10, and the interval G between the nozzle groups of the conventional print head 23 in FIG. 2 is assumed to, for example, 67/1200 inch. Also, ΔH4 is selected to, for example, 1/2400 inch.

As shown in FIG. 7, the first interval deviation ΔH1 is (−)ΔH4, i.e., (−)1/2400 inch because the jetting center point E2 of the magenta ink dot M2 is disposed in front of the jetting center point E1 of the yellow ink dot Y2 with respect to the feeding direction X.

That is, $$\Delta H1 = -\frac{1}{2400} = G - H1 = \frac{67}{1200} - H1\,(\text{inch})$$

$$\therefore\ H1 = \frac{67}{1200} + \frac{1}{2400} = \frac{135}{2400}\,(\text{inch}) = 1428.7\,(\mu\text{m}).$$

On the other hand, the second interval deviation ΔH2 is plus (+) 1/2400 inch because the jetting center point E3 of the cyan ink dot C2 is disposed in back of the jetting center point E2 of the magenta ink dot M2 with respect to the feeding direction X.

Accordingly, the second interval H2 is calculated from the second interval deviation ΔH2 as follows.

$$\Delta H2 = \frac{1}{2400} = G - H2 = \frac{67}{1200} - H2\,(\text{inch})$$

$$\therefore\ H2 = \frac{133}{2400}\,(\text{inch}) = 1407.5\ (\mu\text{m})$$

Also, the third interval deviation ΔH3 equals to the first interval deviation ΔH1 because the jetting center point E4 of the black ink dot K2 is placed in front of the jetting center point E3 of the cyan ink dot C2 in the feeding direction X. That is, the third interval H3 is also 1428.7 μm like the first interval H1

Figure 8:
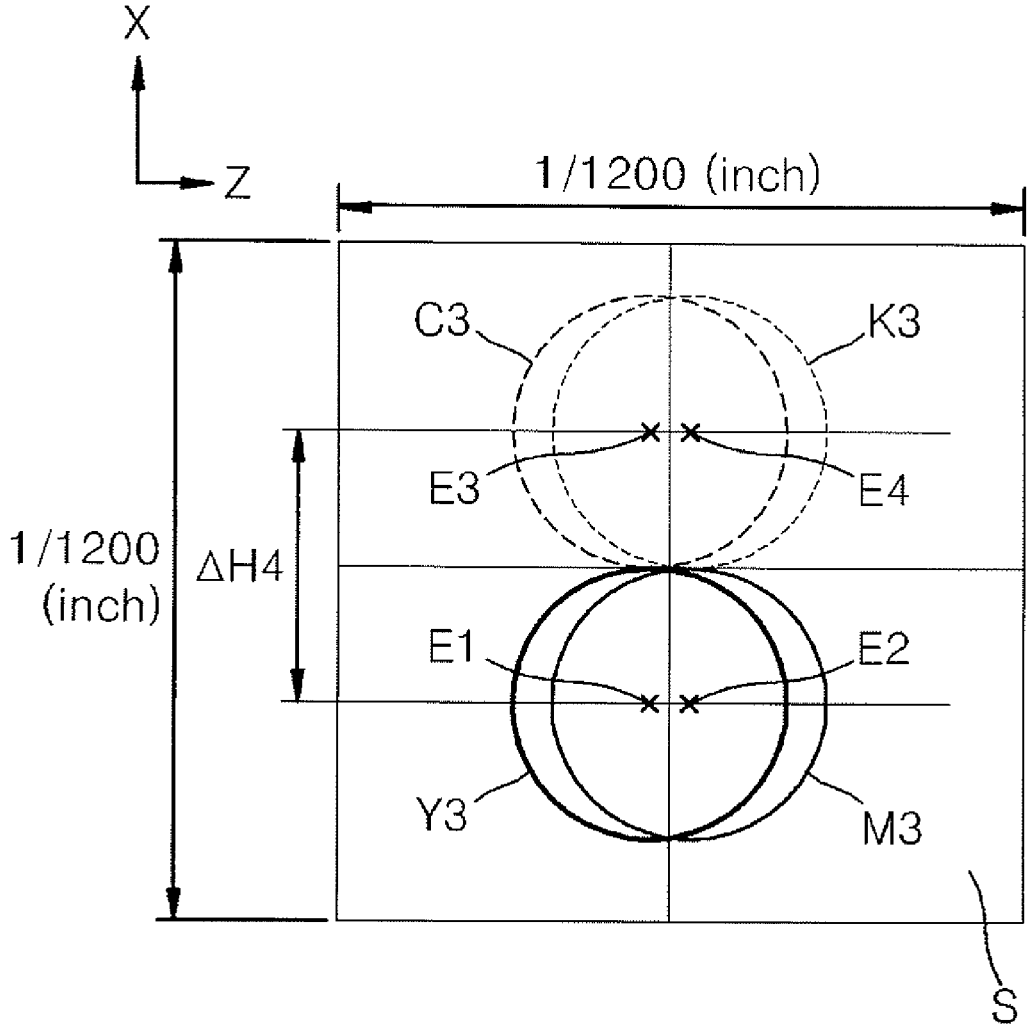
FIG. 8 is a view illustrating a pixel being formed on a printing medium by the print head of FIG. 5.

Referring to FIG. 8, a color pixel is formed as a pattern that the cyan ink dot C3 and the black ink dot K3 overlap each other, and the yellow ink dot Y3 and the magenta ink dot M3 overlap each other. The jetting center point E1 is disposed on the same line of the jetting center point E2, and the jetting center point E3 is disposed on the same line of the jetting center point E4.

The first through third intervals H1 through H3 of the print head 123 may be calculated as follows so as to form the ink dot Y3, M3, C3, and K3 as the same pattern of FIG. 8.

At that time, the first interval deviation ΔH1 becomes zero because the jetting center point E2 of the ink dot M3 equals the jetting center point E1 of the yellow ink dot Y3.

Thus, H1=G=$^{67}/_{1200}$ inch=1418 μm.

Also, the second interval deviation ΔH2 is equal to minus $^{1}/_{2400}$ inch because the jetting center point E3 of the cyan ink dot C3 is placed in front of the jetting center point E3 of the magenta ink dot M3 in the feeding direction X.

Thus, the second interval H2 is $^{133}/_{2400}$ inch, i.e., 1407.5 μm.

The third interval deviation ΔH3 becomes zero because the jetting center point E4 of the black ink dot K3 equals the jetting center point E3 of the cyan ink dot C3.

Thus, H3=G=$^{67}/_{1200}$ inch=1418 μm.

Figure 9:
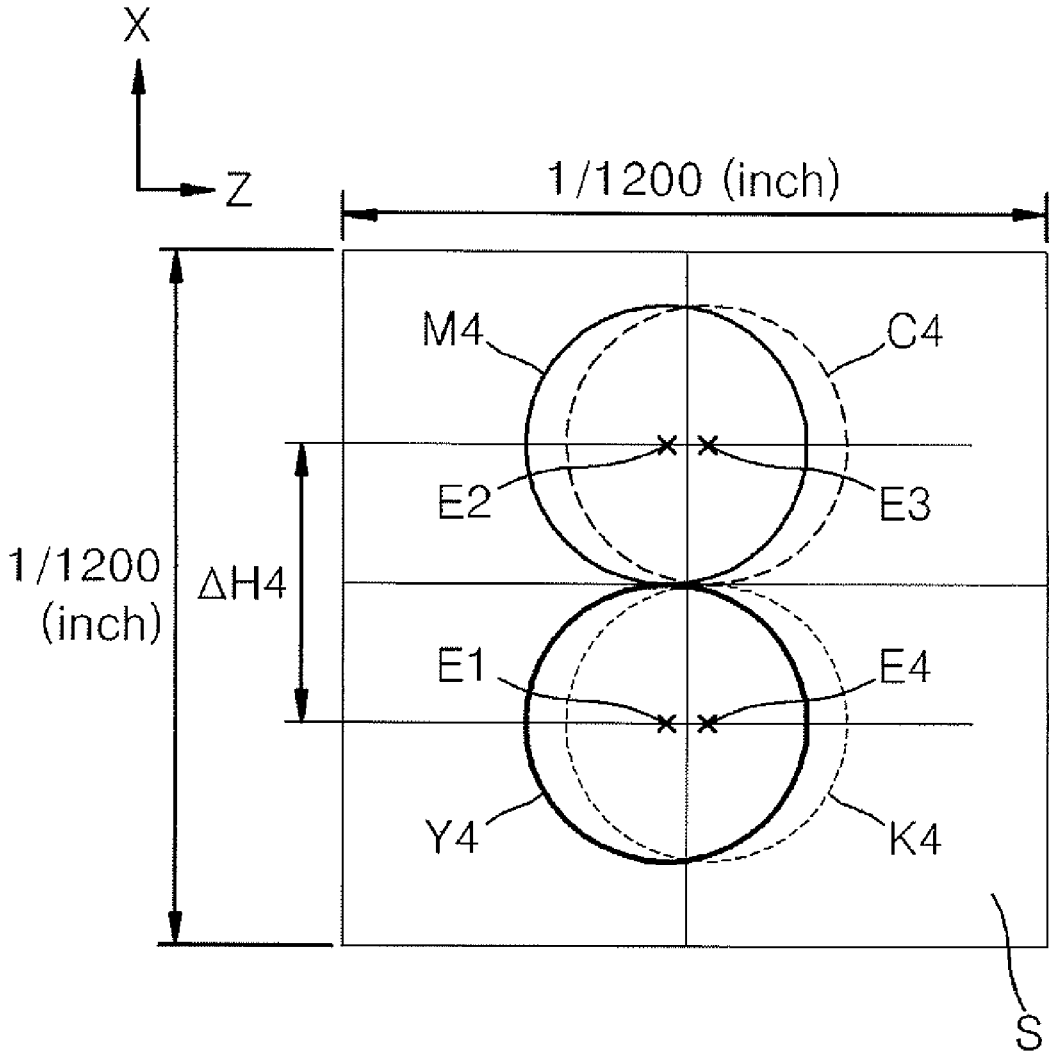
FIG. 9 is a view illustrating a pixel being formed on a printing medium by the print head of FIG. 5.

Referring to FIG. 9, a color pixel is formed as a pattern that the magenta ink dot M4 and the cyan ink dot K4, and the yellow ink dot Y4 and the black ink dot K4 are overlapped with each other. The jetting center point E1 is disposed on the same line of the jetting center point E4, and the jetting center point E2 is disposed on the same line of the jetting center point E3.

The first through third intervals H1 through H3 of the print head 123 may be determined as follows to form the ink dot Y4, M4, C4, and K4 as the same pattern of FIG. 9.

The first interval deviation ΔH1 is equal to minus ΔH4, i.e., minus $^{1}/_{2400}$ inch because the jetting center point E2 of the magenta ink dot M4 is placed in back of the jetting center point E1 of the yellow ink dot Y4 with respect to the feeding direction Z.

Thus, the first interval H1 is $^{135}/_{2400}$ inch, i.e., 1428.7 μm.

Also, the second interval deviation ΔH2 is zero because the jetting center point E3 of the cyan ink dot C4 equals the jetting center point E2 of the magenta ink dot M4.

Accordingly, the second interval H2=G=$^{67}/_{1200}$ inch=1418 μm.

In the meantime, the third interval deviation ΔH3 is equal to plus ΔH4, i.e., plus $^{1}/_{2400}$ inch because the jetting center point E4 of the black ink dot K4 is placed in back of the jetting center point E3 of the cyan ink dot C4 in the feeding direction X.

Thus, the third interval H3 is $^{133}/_{2400}$ inch, i.e., 1407.5 μm.

Herein, the first through third intervals H1 through H3 have different value from each other.

Hence, the ink dots are jetted two by two in different printing region so that the ink drying quality can be more improved than that of when four ink dots are jetted on the same region. Also, the dot coverage which is a region covered with the ink dot within one pixel.

In the foregoing description, it is described that the ink dots are overlapped two by two to form one pixel, but not limited thereto. Alternatively, three ink dots are overlapped on the same printing region and one ink dot may be formed on another printing region, thereby forming one pixel as illustrating in FIG. 10.

Figure 10:
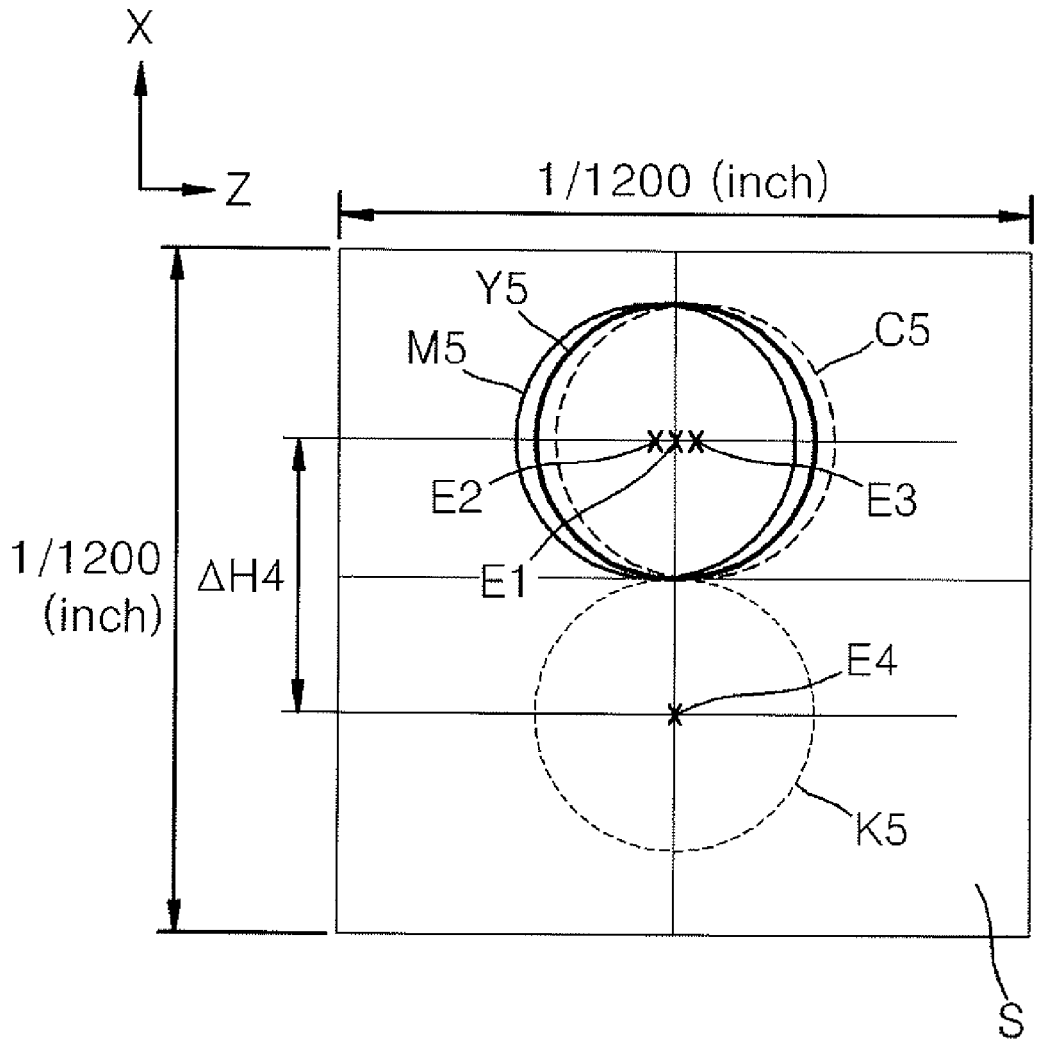
FIG. 10 is a view illustrating a pixel being formed on a printing medium by the print head of FIG. 5.

Referring to FIG. 10, the jetting center point E3 of the cyan ink dot C5, the jetting center point E2 of the magenta ink dot M5, and the jetting center point E1 of the yellow ink dot Y5 are on the same position in the feeding direction X and/or disposed on a line parallel to the direction Z. Accordingly, the first interval deviation ΔH1 and the second interval deviation ΔH2 are both zero.

Accordingly, the first interval H1 and the second interval H2 are $^{63}/_{1200}$ inch, i.e., 1418 μm.

Also, the third interval deviation ΔH3 is plus ΔH4, i.e., plus $^{1}/_{2400}$ inch, because the jetting center point E4 of the black ink dot K5 is placed in back of the jetting center point E3 of the cyan ink dot C5 with respect to the feeding direction X.

Accordingly, the third interval H3 is $^{133}/_{2400}$ inch, i.e., 1407.5 μm.

The following table shows values of the first through third intervals H1 through H3 of the print head 123 to have the ink dot patterns illustrated in FIGS. 7 through 10.

TABLE

| PIXEL PATTERN | FIRST INTERVAL H1 (μM) | SECOND INTERVAL H2 (μM) | THIRD INTERVAL H3 (μM) |
|---|---|---|---|
| FIG. 7 | 1428.7 | 1407.5 | 1428.7 |
| FIG. 8 | 1418 | 1407.5 | 1418 |
| FIG. 9 | 1428.7 | 1418 | 1407.5 |
| FIG. 10 | 1418 | 1418 | 1407.5 |

The values of the first through third intervals H1 through H3 may be varied according to the interval G between the nozzle groups of the conventional print head 23 in FIG. 2, the value of ΔH4, the number of overlapped ink dots, etc. Accordingly, claim scope of the present invention is not limited to the foregoing table data.

In the foregoing description, it is illustrated that the print head 123 has four nozzle groups. However, the present invention may be applied as long as the print head 123 has three or more nozzle groups.

Also, in the foregoing description, the plurality of print head 123 arranged in zigzag along the transverse direction Z, so called, an array type print head 123, is described in detail, but not limited thereto. Alternatively, a page-width-printhead which has a length corresponding to the width of the printing medium in the transverse direction to the feeding direction of the printing medium and is capable of high speed printing like the array type print head may be also applied.

As described above, the print head and the inkjet printer including the same according to the present general inventive concept has an effect as follows.

First, the ink dry quality may be improved.

Second, the dot coverage which is a region covered with the jetted ink may occupy much area of one pixel.

Third, the present general inventive concept may be mechanically realized without changing the controller, thereby reducing a manufacturing cost.

Fourth, the ink dots may be determined to be overlapped with each other by various combinations, thereby enhancing an expression of the color in the pixel unit.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A print head comprising:

a first nozzle group which comprises a plurality of first nozzles arranged linearly in a lengthwise direction of the print head; and a second nozzle group and a third nozzle group which comprise a plurality of second nozzles and a plurality of third nozzles arranged linearly, and are disposed in substantially parallel with each other and spaced from the first nozzle group by a first interval and a second interval at opposite sides of the first nozzle group, respectively, wherein each one of the plurality of first nozzles is arranged linearly in a width direction of the print head with a respective one of the plurality of second nozzles, and one of the plurality of third nozzles, the width direction crossing the length direction, and the first nozzles, the second nozzles, and the third nozzles are configured to eject inks of different colors, respectively.

2. The print head according to claim 1, further comprising:

a fourth nozzle group arranged in substantially parallel with and spaced apart from one of the second and third nozzle groups by a third interval equal to one of the first and second intervals.

3. The print head according to claim 1, further comprising:

a fourth nozzle group arranged in substantially parallel with and spaced apart from one of the second nozzle group and the third nozzle group by a third interval different from at least one of the first and second intervals.

4. An ink jet printer comprising:

a print head which comprises a first nozzle group which comprises a plurality of first nozzles arranged linearly in a lengthwise direction of the print head, and a second nozzle group and a third nozzle group which comprise a plurality of second nozzles and a plurality of third nozzles arranged linearly in the lengthwise direction of the print head, and are disposed in substantially parallel with each other and spaced from the first nozzle group by a first interval and a second interval at opposite sides of the first nozzle group, respectively;

an ink tank; and a base plate which provides an ink of the ink tank to the print head, and supports the print head so that a lengthwise direction of each nozzle group can be crossed to a feeding direction of a printing medium, wherein each one of the plurality of first nozzles is arranged linearly in a width direction of the print head with a respective one of the plurality of second nozzles, and one of the plurality of third nozzles, the width direction crossing the length direction, and the first nozzles, the second nozzles, and the third nozzles are configured to eject inks of different colors, respectively.

5. The ink jet printer according to claim 4, wherein the print head further comprises a fourth nozzle group arranged in substantially parallel with and spaced apart from one of the second and third nozzle groups by a third interval equal to one of the first and second intervals.

6. The ink jet printer according to claim 5, wherein the print head comprises a plurality of print heads disposed in the base plate along a transverse direction to the feeding direction.

7. The ink jet printer according to claim 5, further comprising:

a feeding unit which feeds the printing medium to the print head; and a controller which controls the print head and the feeding unit so that at least one of ink dots generated on the printing medium by each nozzle group is not aligned with the other ink dots in the feeding direction.

8. The ink jet printer according to claim 4, wherein the print head further comprises a fourth nozzle group arranged in substantially parallel with and spaced apart from one of the second nozzle group and the third nozzle group by a third interval different from at least one of the first and second intervals.

9. The ink jet printer according to claim 8, wherein the print head comprises a plurality of print heads disposed in the base plate along a transverse direction to the feeding direction.

10. The ink jet printer according to claim 8, further comprising:

a feeding unit which feeds the printing medium to the print head; and a controller which controls the print head and the feeding unit so that at least one of ink dots generated on the printing medium by each nozzle group is not aligned with the other ink dots in the feeding direction.

11. The ink jet printer according to claim 4, wherein the print head comprises a plurality of print heads disposed in the base plate along a transverse direction to the feeding direction.

12. The ink jet printer according to claim 4, further comprising:

a feeding unit which feeds the printing medium to the print head, and a controller which controls the print head and the feeding unit so that at least one of ink dots generated on the printing medium by each nozzle group is not aligned with the other ink dots in the feeding direction.

13. A print head usable with an image forming apparatus, comprising:

a first nozzle group having a plurality of first nozzles disposed on a first line;

a second nozzle group having a plurality of second nozzles disposed on a second line substantially parallel to the first line and spaced apart from the first line by a first distance; and a third nozzle group having a plurality of third nozzles disposed on a third line substantially parallel to one of the first line and the second line and spaced apart from one of the first line and the second line by a second distance, wherein each one of the plurality of first nozzles is arranged linearly in a width direction of the print head with a respective one of the plurality of second nozzles, and one of the plurality of third nozzles, the width direction crossing the length direction, and the first nozzles, the second nozzles, and the third nozzles are configured to eject inks of different colors, respectively.

14. A print head usable with an image forming apparatus, comprising:

a first nozzle group having a plurality of first nozzles disposed on a first line to eject ink of a first color;

a second nozzle group having a plurality of second nozzles disposed on a second line substantially parallel to the first line and spaced apart from the first line by a first distance to eject ink of a second color;

a third nozzle group having a plurality of third nozzles disposed on a third line substantially parallel to the second line and spaced apart from the second line by a second distance to eject ink of a third color; and a fourth nozzle group having a plurality of fourth nozzles disposed on a fourth line substantially parallel to the third line and spaced apart from the third by a third distance to eject ink of a fourth color, wherein at least two of the first, the second, and the third distance are different from each other, each one of the plurality of first nozzles is arranged linearly in a width direction of the print head with a respective one of the plurality of second nozzles, and one of the plurality of third nozzles, the width direction crossing the length direction, and the first nozzles, the second nozzles, and the third nozzles are configured to eject inks of different colors, respectively.

15. A print head usable with an image forming apparatus, comprising:

a base plate; and a plurality of print heads disposed on the base plate and spaced apart from each other, each print head comprising:

a first nozzle group having a plurality of first nozzles disposed on a first line, a second nozzle group having a plurality of second nozzles disposed on a second line substantially parallel to the first line and spaced apart from the first line by a first distance, and a third nozzle group having a plurality of third nozzles disposed on a third line substantially parallel to one of the first line and the second line and spaced apart from one of the first line and the second line by a second distance, each one of the plurality of first nozzles is arranged linearly in a width direction of the print head with a respective one of the plurality of second nozzles, and one of the plurality of third nozzles, the width direction crossing the length direction; and the first nozzles, the second nozzles, and the third nozzles are configured to eject inks of different colors, respectively.

16. An image forming apparatus comprising:

a print head comprising a first nozzle group having a plurality of first nozzles disposed on a first line, a second nozzle group having a plurality of second nozzles disposed on a second line substantially parallel to the first line and spaced apart from the first line by a first distance, and a third nozzle group having a plurality of third nozzles disposed on a third line substantially parallel to one of the first line and the second line and spaced apart from one of the first line and the second line by a second distance; and a controller to make a relative movement of a printing medium and the print head to form first, second, and third ink dots in a corresponding pixel of the printing medium at different regions of a pixel of the printing medium.

17. The image forming apparatus of claim 16, wherein at least one of the different regions of the pixel is disposed on an upper side or a lower side of a center line of the pixel.

18. An image forming apparatus comprising:

a print head comprising a first nozzle group having a plurality of first nozzles disposed on a first line to eject ink of a first color, a second nozzle group having a plurality of second nozzles disposed on a second line substantially parallel to the first line and spaced apart from the first line by a first distance to eject ink of a second color, a third nozzle group having a plurality of third nozzles disposed on a third line substantially parallel to the second line and spaced apart from the second line by a second distance to eject ink of a third color, and a fourth nozzle group having a plurality of fourth nozzles disposed on a fourth line substantially parallel to the third line and spaced apart from the third by a second distance to eject ink of a fourth color; and a controller to make a relative movement of a printing medium and the print head to form first, second, third, and fourth ink dots in a corresponding pixel of the printing medium at first, second, third, and fourth regions of a pixel of the printing medium using the first, second, third, and fourth nozzles of the first, second, third, and fourth nozzle groups, respectively.

19. The image forming apparatus of claim 18, wherein the first, second, third, and fourth ink dots are disposed in the different regions disposed in a direction within the pixel.

20. The image forming apparatus of claim 18, wherein at least one of the first, second, third, and fourth ink dots does not overlap another one of the first, second, third, and fourth ink dots.

21. The image forming apparatus of claim 18, wherein at least one of the first, second, third, and fourth ink dots does not overlap at least the other one of the first, second, third, and fourth ink dots.

22. The image forming apparatus of claim 18, wherein at least two of the first, second, third, and fourth ink dots overlap each other.

23. The image forming apparatus of claim 18, wherein at least two of the first, second, third, and fourth ink dots are disposed in a feeding direction of the printing medium.

24. The image forming apparatus of claim 18, wherein the first, second, third, and fourth ink dots are disposed to overlap the adjacent ones of the first, second, third, and fourth ink dots.

* * * * *